US010083828B2

(12) United States Patent
Kuepper

(10) Patent No.: US 10,083,828 B2
(45) Date of Patent: Sep. 25, 2018

(54) LAMP WITH HEAT-SHIELDING ELEMENT

(71) Applicant: KONINKLIJKE PHILIPS N.V., Eindhoven (NL)

(72) Inventor: Lukas Kuepper, Aachen (DE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/523,633

(22) PCT Filed: Oct. 30, 2015

(86) PCT No.: PCT/EP2015/075300

§ 371 (c)(1),
(2) Date: May 1, 2017

(87) PCT Pub. No.: WO2016/071238

PCT Pub. Date: May 12, 2016

(65) Prior Publication Data

US 2017/0309467 A1 Oct. 26, 2017

(30) Foreign Application Priority Data

Nov. 7, 2014 (EP) ..... 14192278

(51) Int. Cl.
*H01K 1/32* (2006.01)
*F21S 41/162* (2018.01)
(Continued)

(52) U.S. Cl.
CPC ..... *H01K 1/32* (2013.01); *F21S 41/162* (2018.01); *F21S 41/435* (2018.01);
(Continued)

(58) Field of Classification Search
CPC ..... H01K 1/32; H01K 1/325; F21S 41/162; F21S 48/1168
(Continued)

(56) References Cited

U.S. PATENT DOCUMENTS 4,210,841 A 7/1980 Holub et al.
4,636,923 A 1/1987 Oyama et al.
(Continued)

FOREIGN PATENT DOCUMENTS

DE 102008022144 A1 11/2009
EP 0708978 A1 5/1996

OTHER PUBLICATIONS

EPO as ISA, "International Search Report and Written Opinion" dated Feb. 11, 2016 from International Application No. PCT/EP2015/075300, filed Oct. 30, 2015, 13 pages.
(Continued)

*Primary Examiner* — Bryon T Gyllstrom

(57) ABSTRACT

A lamp has a light emitting element within a sealed transparent vessel. The vessel comprises a cylindrical section with a longitudinal axis L in parallel to a longitudinal axis F of the light emitting element. In order to provide a lamp suited for compact reflectors, a heat shielding element is arranged to shield at least infrared light. The heat shielding element is arranged in parallel to the longitudinal axis F of the light emitting element and has an axial extension of at least 80% of the light emitting element. The heat shielding element is arranged to shield infrared light emitted into directions perpendicular to the longitudinal axis F covering a circumferential extension of 20°-120° measured in cross section.

19 Claims, 3 Drawing Sheets

(51) Int. Cl.

| | |
|---|---|
| ***F21S 41/43*** | (2018.01) |
| ***H01J 61/02*** | (2006.01) |
| ***H01J 61/35*** | (2006.01) |
| ***H01K 1/26*** | (2006.01) |
| *F21S 41/17* | (2018.01) |
| *F21S 41/37* | (2018.01) |

(52) U.S. Cl.
CPC ..... *H01J 61/025* (2013.01); *H01J 61/35* (2013.01); *H01K 1/26* (2013.01); *H01K 1/325* (2013.01); *F21S 41/17* (2018.01); *F21S 41/37* (2018.01)

(58) Field of Classification Search
USPC ..... 362/516
See application file for complete search history.

(56) References Cited

U.S. PATENT DOCUMENTS 4,816,974 A * 3/1989 Gordin ..... F21V 7/0025 313/114
4,965,485 A * 10/1990 Tarumi ..... H01K 1/32 313/111
4,987,343 A * 1/1991 Kosmatka ..... F21S 41/162 315/82
5,539,628 A * 7/1996 Seib ..... F21V 9/00 362/255
8,203,257 B2 * 6/2012 Kuepper ..... H01K 1/26 313/112
2007/0262695 A1 * 11/2007 Reisman ..... H01J 9/20 313/485
2009/0316268 A1 * 12/2009 Werdecker ..... C03C 17/25 359/599
2016/0148798 A1 * 5/2016 Kowalski ..... F21S 41/125 362/516

OTHER PUBLICATIONS

"ECE Regulation No. 99", Jan. 1, 2009, retrieved May 5, 2015 from the Internet: URL:http://ww.unece.org/fileadmin/DAM/trans/main/wp29/wp29regs/r099r2e.pdf, p. 22.

Extended European Search Report dated May 19, 2015, European Application No. 14192278.1, 6 pages.

* cited by examiner

FIG. 5
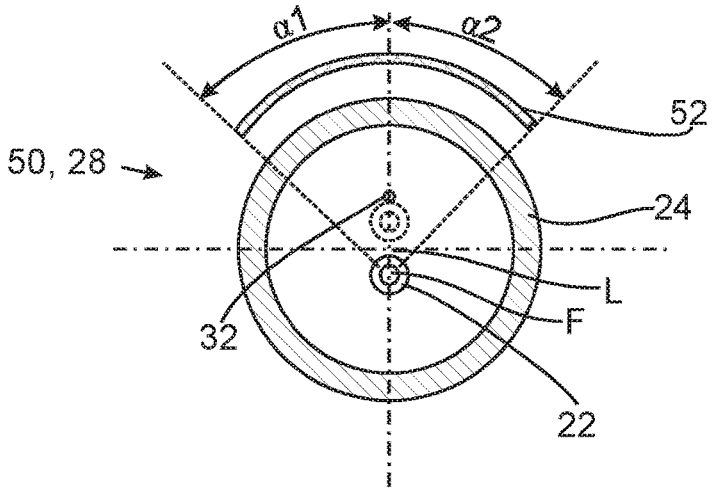
FIG. 6
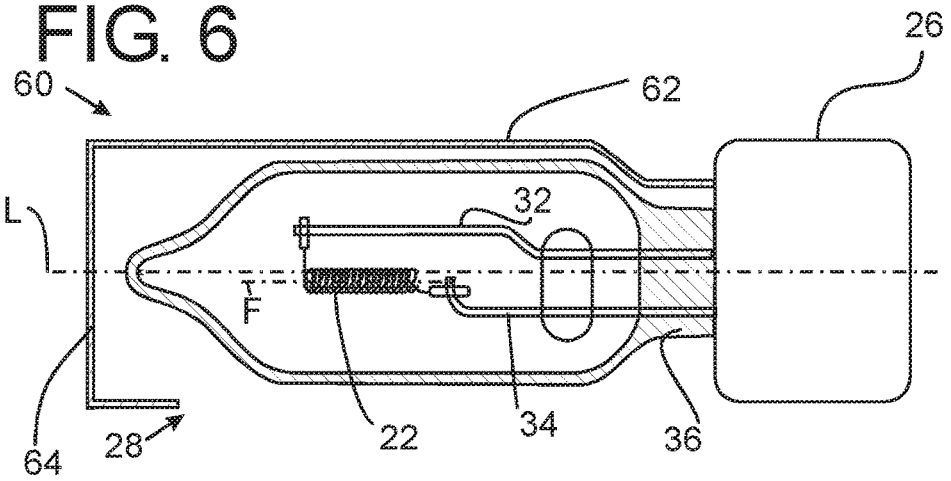
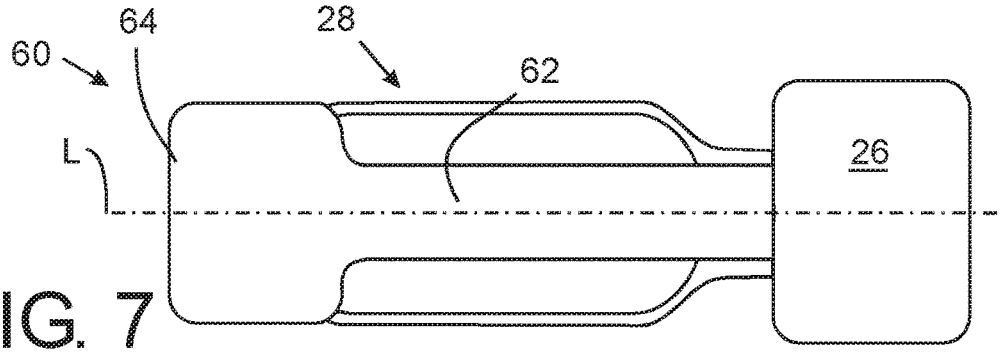
FIG. 7

LAMP WITH HEAT-SHIELDING ELEMENT

CROSS-REFERENCE TO RELATED APPLICATIONS

The present application is a § 371 application of International Application No. PCT/EP2015/075300 filed on Oct. 30, 2015 and entitled "LAMP WITH HEAT-SHIELDING ELEMENT", which claims the benefit of European Patent Application No. 14192278.1 filed on Nov. 7, 2014. International Application No. PCT/EP2015/075300 and European Patent Application No. 14192278.1 are incorporated herein.

TECHNICAL FIELD

The invention relates to a lamp, in particular for use in a vehicle headlight, and to a vehicle headlight including a lamp.

BACKGROUND ART

A plurality of different types of lamps for use in a vehicle headlight exists on the market today. Both incandescent halogen lamps and electrical discharge lamps comprise a light emitting element within a sealed transparent vessel.

DE 10 2008 022 144 A1 describes a halogen lamp for use in a vehicle headlight. In an example, the lamp is a H7 lamp with electrical power of 55 W at 13.2 V. A transparent lamp vessel with a cap at one end and an opaque covering at the other end comprises a cylindrical section around an axially arranged filament. A section surrounding the cylindrical section in ring-like manner is provided with an interference filter for reflecting infrared light to achieve a higher efficiency. The width of the filtering section corresponds to the length of the filament of 4-6.5 mm. The interference filter does not fully extend around the filament, but is comprised of ring segments separated by non-coated portions.

U.S. Pat. No. 4,987,343A discloses a combined glare and heat shield for vehicle headlamp applications. Such composite heat shield member is configured and located inside the headlamp assembly with particular respect to the light source so as to avoid shadowing by this lamp component in the projected light beam pattern.

DISCLOSURE OF INVENTION

It may be considered an object to provide a lamp and vehicle headlight suited especially for compact reflectors.

This object is solved by a lamp according to claim 1 and by a vehicle headlight according to claim 13. Dependent claims refer to preferred embodiments of the invention.

The inventor has recognized a potential problem with conventional lamps of incandescent or electrical discharge type in more and more compact reflectors. While the overall height of a reflector of a vehicle headlight was about 80 mm in recent years, more complex reflector designs, e.g. with reflector sizes of 60 mm or less, particularly with up to 50 mm or less, may be envisioned. Within such more compact reflectors, a heat load generated from an incandescent or electrical discharge type light emitting element on the reflector will be significant. With conventional lamps this would necessitate materials such as metal or glass for the reflector which can withstand high temperatures.

In contrast, the current invention proposes to limit excessive heating of the reflector surface with a lamp including a heat shielding element. According to the invention, the heat shielding element may be arranged to limit the heat load on some portions of the reflector while only minimally disturbing the reflected beam.

The lamp according to the invention comprises a light emitting element, such as e.g. an electrode gap between opposing electrodes in the case of an electrical discharge lamp or a filament in the case of an incandescent lamp, arranged within a sealed transparent vessel, e.g. made of transparent ceramics or glass, in particular quartz glass.

The transparent vessel may be overall cylindrical in shape, but at least comprises a cylindrical section. A longitudinal, preferably central longitudinal axis of the cylindrical section is arranged in parallel to a longitudinal axis of the light emitting element, i.e. to the filament winding axis in the case of an incandescent lamp and to the electrode gap in the case of an electrical discharge lamp. The cylindrical section of the transparent vessel encloses the light emitting element, such that a main portion of the light emitted from the light emitting element is emitted through the cylindrical section of the sealed transparent vessel.

According to the invention, a heat shielding element is arranged in parallel to the longitudinal axis of the light emitting element and has an axial extension of at least 80% of the axial length of the light emitting element. In particular, it is preferred that the heat shielding element is arranged to cover at least the full axial length of the light emitting element. In some preferred embodiments, the axial extension of the heat shielding element is 80-125% of the axial length of the light emitting element, further preferred 90-110%. As will become apparent in connection with alternative embodiments, the axial extension of the heat shielding element may also be larger than the axial length of the light emitting element. In particular, this will be the case for embodiments where the heat shielding element is fixed to the lamp cap and extends in axial direction up to the light emitting element, and in some embodiments even up to and beyond the tip of the sealed transparent vessel.

In circumferential extension, the heat shielding element according to the invention is arranged to shield light emitted from the light emitting element into selected radial directions, i.e. in directions perpendicular to the longitudinal axis of the light emitting element, so as to cover a circumferential extension of 20-120°, preferably 60-110°, further preferred, 80-100°. It is particularly preferred for the heat shielding element to be arranged to cover a circumferential extension of 90°. The circumferential extension may be measured in cross-section with the angle legs extending from the central longitudinal axis of the light emitting element.

A heat shielding element according to the invention is effective to shield at least infrared light emitted from the light emitting element, e.g. by reflection or scattering. Thus, the amount of infrared light emitted into directions behind the heat shielding element (as viewed from the center of the light emitting element) is strongly reduced. If the lamp is arranged within a reflector such that the thus shielded direction corresponds to the most critical direction with respect to the heat load, namely the upward direction, the heat shielding element significantly alleviates problems of excessive heat load on the reflector.

The heat load on the reflector surface results mainly from heat convection and heat radiation. In the usual horizontal arrangement of a lamp within a vehicle headlight reflector, the highest load from convection is present above the lamp, in particular above the light emitting element. By providing a lamp with a heat shielding element arranged to shield the upper reflector portion, the radiation heat load on this portion of the reflector may be eliminated or at least substantially reduced, such that the overall distribution of heat within the reflector is improved and problems with a hot spot above the lamp may be reduced.

This reduction may even be achieved with a heat shielding element covering a circumferential extension as narrow as 20° or 30°, in particular if the directly upward direction is shielded. Larger circumferential coverage achieves a broader shield effect.

According to the invention, the size of the heat shielding element is limited, so as to minimize optical effects on the reflected beam. In particular, a circumferential extension is limited to at most 120°, preferably at most 100°, further preferred at most 90°. Light emitted from the light emitting element into other directions is not altered by the heat shielding element, such that a substantial portion of the emitted light remains undisturbed.

A vehicle headlight according to the invention includes a lamp as described above arranged in a reflector. The reflector may be made of a plastic material with a reflective coating. The lamp may then be arranged horizontally within the reflector, oriented such that the heat shielding element is arranged above the light emitting element, thereby shielding infrared light emission into the upward direction.

The lamp and vehicle headlight according to the invention allow to avoid heat problems within the reflector. In particular, the heat shielding element makes it possible to use plastic materials for the reflector, even for lamps of higher electrical power and for more compact reflectors.

According to one preferred embodiment of the invention, a heat shielding element may be provided as a coating arranged on the transparent vessel. Thus, a shielding section of the transparent vessel may be achieved, effective to block or at least substantially attenuate emission of infrared radiation into the direction blocked by the shielding section. Preferably, the coating is limited only to the shielding section with the above specified extension in axial and circumferential directions, such that there is no infrared filter or mirror coating on the remaining portion of the circumferential extension, e.g. such that the cylindrical portion is otherwise uncoated.

The coating may be a mirror coating, fully reflecting both infrared light and light in visible range. Alternatively a coating may be an infrared filter coating, allowing transmission of light in the visible range while reflecting infrared light.

In the case of a mirror coating, infrared radiation in all spectral ranges may be effectively blocked. In the alternative case of an infrared filter coating, the coating will in practice have a wavelength-selective reflectivity, allowing at least the largest part of light in the visible range to be transmitted through the coating, while at least the largest part of infrared light will be reflected. For example, an infrared filter coating may be provided as a plurality of coatings applied on top of each other, forming an interference filter. For example, an interference filter may be formed by subsequent layers of $SiO_2$ and $Nb_2O_5$ of selected thickness to achieve an interference filter with the desired spectral selectivity.

In a preferred embodiment, the lamp is of incandescent type, in particular preferred as a halogen lamp. The lamp may thus comprise a filament as light emitting element. The filament may be wound around a longitudinal filament axis.

At least a first and a second holding wire extending from a lamp cap may be provided to hold the filament. The first of the holding wires may extend in parallel to the filament at a distance thereto. Since in particular in reflector-type vehicle headlights a usual orientation of a lamp within a reflector is with the first holding wire directly above the filament, it is preferred to have the heat shielding element arranged symmetrically above the filament in a thus oriented lamp. Therefore, the heat shielding element may be provided on the lamp in an arrangement symmetrical to a vertical plane, i.e. to an axial symmetry plane defined through the filament axis and the first holding wire extending in parallel thereto.

In a preferred embodiment, the filament is chosen such that the lamp has a nominal power within the range of at least 60 W, e.g. 60-75 W at a voltage of 13.2 V. In particular at this increased operating power as compared to known automotive lamps today, including the H7, problems with increased heat load may occur, such that the heat shielding element according to the invention is all the more effective.

While according to one embodiment of the invention the heat shielding element may be provided as a coating on the transparent vessel, the heat shielding element may, according to an alternative embodiment, also be provided as a metal shield. The metal shield may preferably be arranged at a distance from the cylindrical section of the transparent vessel. Further preferably, the metal shield may be fixed to the lamp, such that it is automatically positioned within a reflector if the lamp is mounted. A metal shield, particularly preferred as a metal sheet, effectively blocks light both in the visible range and in the infrared range. The metal shield may preferably be arranged to cover the axial length of the filament and may be provided at a distance of e.g. 0.5-5 mm from the transparent vessel. A shield may also advantageously influence convection. Preferably, the resulting heat load on critical parts of the reflector is thus reduced not only by blocking infrared radiation, but also dispersing convection in the upward direction.

In a preferred embodiment, the metal shield may be fixed to a cap of the lamp, extending in parallel to the longitudinal axis of the cylindrical section.

If the heat shielding element is reflective for light in the visible range, it preferably has a shape effective to avoid glare in the reflected beam formed in a vehicle headlight. In the case of a coating on the cylindrical vessel, which may be a fully reflective mirror coating or an infrared filter coating which is also at least partly reflective for light in the visible range, the reflective surface will be cylindrical and concave. In the case of a metal shield provided as heat shielding element, which is at least partly reflective, the inner surface thereof is preferably also concave, particularly preferred of partly cylindrical shape. Mirror images creating glare may be avoided if the position of the mirror image created of the light emitting element is located between the actual light emitting element and the heat shielding element. If a lamp with a heat shielding element of corresponding shape where the heat shielding element is above the light emitting element, is positioned within the reflector of a vehicle headlight, a mirror image appears above the actual light emitting element. In this case, the light reflected at the heat shielding element will not lead to glare.

A corresponding shape of the heat shielding element may be achieved by a partly cylindrical shape thereof, the cylinder axis of which is arranged closer to the heat shielding element than the light emitting element.

The vehicle headlight according to the invention comprises a reflector made of a plastic material. Due to the heat shielding element, the reflector may be especially compact, such that a distance from the light emitting element to the reflector surface, in particular to the critical top portion thereof, may be as small as 30 mm or less, or even 25 mm or less. The distance may be measured within a cross-sectional plane, perpendicular to the longitudinal axis of the cylindrical part of the vessel. The cross-sectional plane may be arranged within a center of the light emitting element.

According to a further preferred embodiment of the invention, the vehicle headlight comprises a reflector made of a thermoplastic material. Such thermoplastic material has significant processing advantages due to short cycle times and generally no necessity for secondary processing, as well as excellent surface quality, weight savings and freedom of design. In particular, amorphous HT thermoplastic materials are preferred, such as PC-HT, PEI, PSU and PES. Especially in compact reflectors, the use of such thermoplastic materials with long-term stability for temperatures e.g. up to 180° C. (PSU), 195° C. (PC-HT) or up to 210° C. (PEI, PES) are made possible by the heat shielding element according to the invention.

These and other aspects of the invention will be apparent from and elucidated with reference to the embodiments describe hereinafter.

BRIEF DESCRIPTION OF THE DRAWINGS

FIG. 5 shows a cross-sectional view of the lamp of FIG. 4 with the section taken along B . . . B;

FIG. 6 shows a longitudinal sectional view of a third embodiment of a lamp;

FIG. 7 shows a top view of the lamp of FIG. 6.

DESCRIPTION OF EMBODIMENTS

Figure 1:
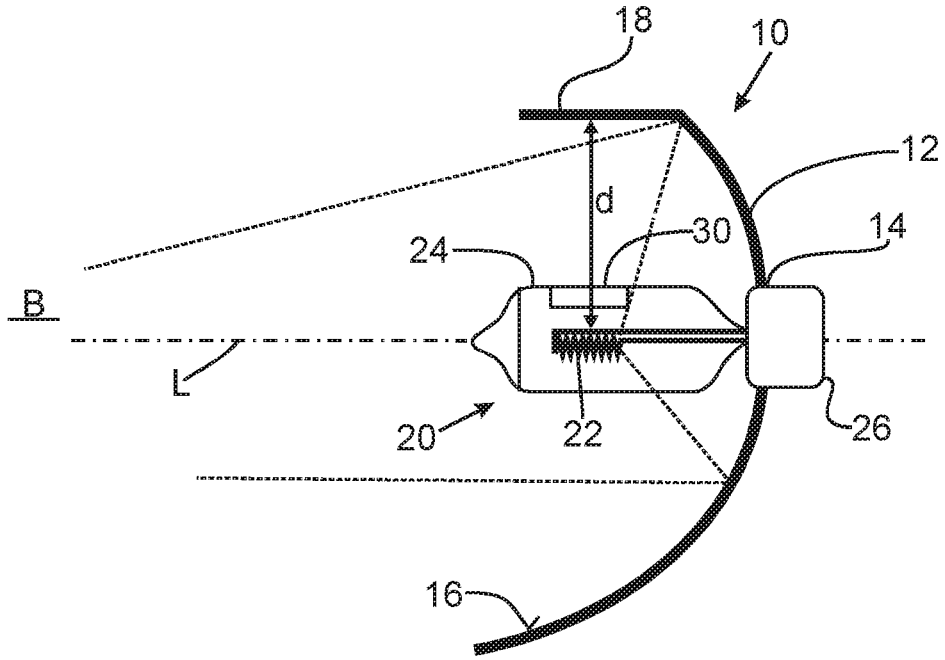
FIG. 1 shows in a symbolical side view an automotive headlight with a lamp arranged within a reflector.

FIG. 1 shows a symbolic representation of a vehicle headlight 10 of the reflector type, including a lamp 20 mounted within a reflector 12. The lamp 20 is a halogen incandescent lamp with a filament 22 as light emitting element within a transparent glass bulb 24. The lamp 20 comprises a lamp cap 26 shown only symbolically, mounted within a mounting position 14 of the reflector 12.

The reflector 12 comprises a reflector body with an inner reflector surface 16. The reflector body 12 is made out of a thermoplastic material, such as PSU, PC-HT, PEI or PES. Light emitted from the light emitting element 22 of the lamp 20 is reflected at the reflector surface 16 to form an illumination beam B to illuminate in front of a vehicle.

In operation of the lamp 20, heat is generated by the light emitting element 22. For example, the preferred embodiment of a lamp 20 is disposed to have an electrical power of 69 W if operated at a voltage of 13.2 V. A relatively large proportion of the electrical power is not converted into light, but generates heat that is dissipated within the reflector by convection, conduction (through the lamp cap 26) and radiation, i.e. emission of infrared light.

The invention is aimed in particular towards compact headlights with a relatively small distance between the light emitting element 22 and the reflector surface 16. The critical distance is shown in FIG. 1 as d, measured directly above the light center of the emitting element 22 in a plane perpendicular to a longitudinal axis L of the lamp 20. In compact reflectors, the distance d may be as small as 30 mm or less, for very compact reflectors even 25 mm or less.

In particular, the heat load on a top portion 18 of the reflector 12 may be critical due to convection, which is directed upward from the light emitting element 22, in addition to the infrared radiation.

While the reflector 12 may be made out of a material which is able to tolerate high temperature even over a long time, such as metal, glass or thermoset, in particular BMC, thermoplastic materials are preferred as being more light weight and offering both processing advantages and superior surface quality. However, their long-term temperature tolerance is limited, thus creating potential problems in particular in very compact reflectors.

A heat shielding element 30 is provided to reflect infrared light emitted from the light emitting element 22 into the direction of the top portion 18 of the reflector, so as to reduce the heat load onto this most critical part of the reflector.

In the following, embodiments of a lamp to be used in such a reflector will be described in detail. Generally, lamps may be used with dimensions e.g. according to newly proposed halogen types H18 (single filament lamp) or H19 (two-filament lamp).

Figure 2:
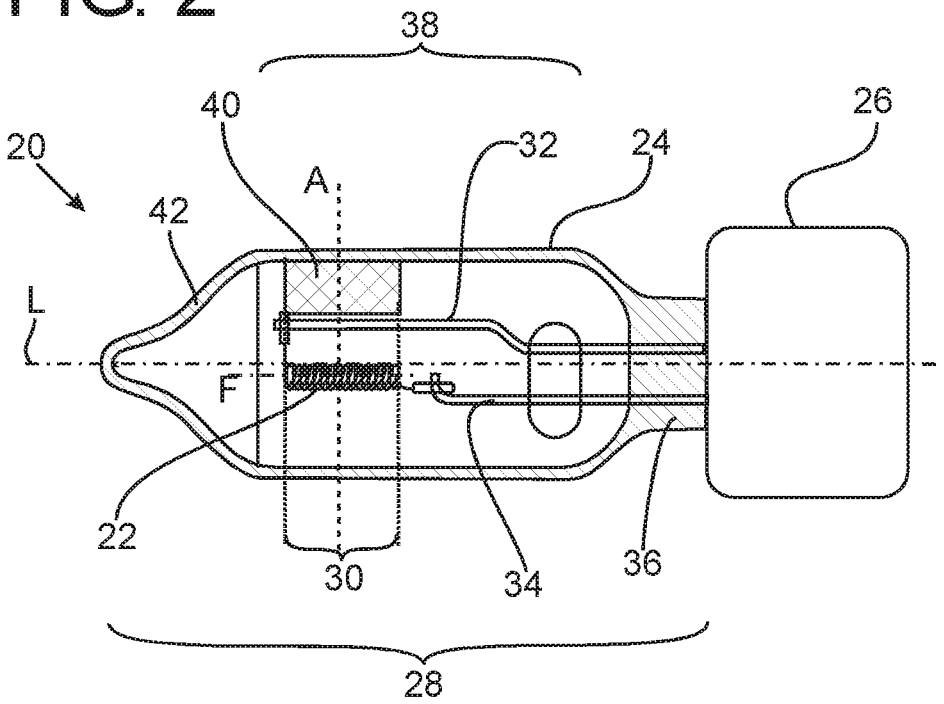
FIG. 2 shows a longitudinal sectional view of a first embodiment of a lamp.

FIG. 2 shows a first embodiment of a lamp 20 with a symbolically shown lamp cap 26 and a burner 28. A filament is held within the bulb 24 by holding wires 32, 34 extending from the lamp cap 26, including a first, longer holding wire 32 and a second, shorter holding wire 34. The end portion of the first holding wire 32 extends in parallel to the filament 22. In the horizontal position as shown in FIG. 2, which is the usual position during operation within a vehicle headlight, the first holding wire 32 is arranged directly above the filament 22, as also visible from the cross-sectional view in FIG. 3.

The bulb 24 comprises a pinch portion 36 mounted to the lamp cap 26, a central cylindrical portion 38 surrounding the filament 32 and an opaque covering 42 at the top portion. The central longitudinal axis L is defined as the center of the cylindrical portion 38.

The filament 22 is oriented in longitudinal direction within the bulb 24, i.e. with its longitudinal axis F arranged in parallel to the longitudinal axis L of the lamp 20, in the embodiment shown with a small offset.

The lamp 20 comprises as a heat shielding element a shielding portion 30 of the cylindrical portion 38 of the bulb 24, where an infrared filter coating 40 is applied. The infrared filter coating may preferably be comprised of a plurality of layers forming an interference filter, e.g. consecutive layers of $Nb_2O_5$ and $SiO_2$ of carefully selected layer thickness to achieve the desired spectral filter response. The infrared filter layer 40 is strongly reflecting for infrared light, in particular for infrared light of wavelengths starting at 1000 nm. Light in the visible range will be transmitted through the infrared filter coating 40, although inevitably a small portion thereof will still be reflected, because in practice the spectral response of an interference filter will not be that of an ideal band-stop filter only for light in the infrared range.

The size and positioning of the filter portion 30 is selected according to both thermal and optical considerations. To achieve the desired thermal effect of reducing heat load on the top portion 18 of the reflector 12, the infrared filter portion is arranged above the filament 22 to reflect infrared light from the filament 22 into the direction of the critical top part 18. On the other hand, the size and position of the shielding portion 30 is chosen to minimize optical effects on the resulting beam B.

In the example shown, the shielding portion 30 is of a partial cylindrical shape, bordered by straight edges. In axial direction, the length of the shielding portion 30 is equal to the length of the filament 22. The shielding portion 30 is arranged in parallel to the filament 22 to cover the full axial length thereof.

Figure 3:
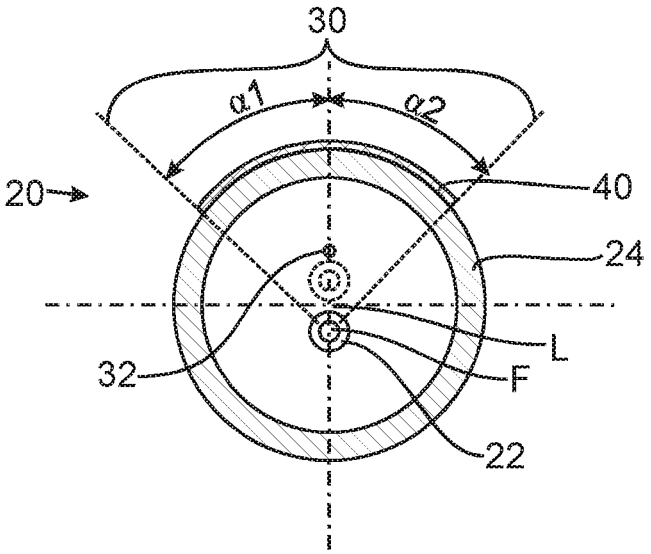
FIG. 3 shows a cross-sectional view of the lamp of FIG. 2, with the section taken along A . . . A in FIG. 2.

In circumferential direction, the extension of the shielding portion 30 extends, as in particular visible from FIG. 3, over an angular range which may be defined by the angles $\alpha 1$, $\alpha 2$ with the horizontal direction. Preferably, the arrangement is symmetrical, such that $\alpha 1$ is equal to $\alpha 2$. A significant shielding effect has been achieved with a circumferential extension of 90° in total, i.e. with both $\alpha 1$, $\alpha 2$ being equal to 45°.

For vehicle headlights 10 of the reflector type as shown in FIG. 1, the portions of light emitted from the filament 22 into the upper regions 18 of the reflector 12 are used to illuminate areas in front of the vehicle, further away from the optically critical cut-off edge. Thus, for headlights of the reflector type, the described symmetrical arrangement of the shielding portion 30 symmetrically above the filament 22 has proven to introduce optical effects only in non-critical portions of the resulting beam B. Due to the limited extension of the shielding portion 30, the optical effects are thus tolerable, because light emitted from the filament 22 into directions outside of the shielding portion 30 can pass without optical effects such as color change or partial reflection, which is inevitably present at the infrared filter coating 40.

A certain portion of light in the visible range, which is reflected at the filter coating 40, forms a mirror image of the filament 22, shown in dashed lines in FIG. 3. Since the filter coating 40 is applied on the cylindrical portion 38, it forms a concave, partly reflecting surface bent around the central longitudinal axis L. The filament 22 is arranged below the longitudinal axis L, so that the mirror image will be positioned in between the actual filament 22 and the filter coating 40 as shown. If the mirror image is created in this area, there will be no glare in the resulting beam B of the headlight 10.

Figure 4:
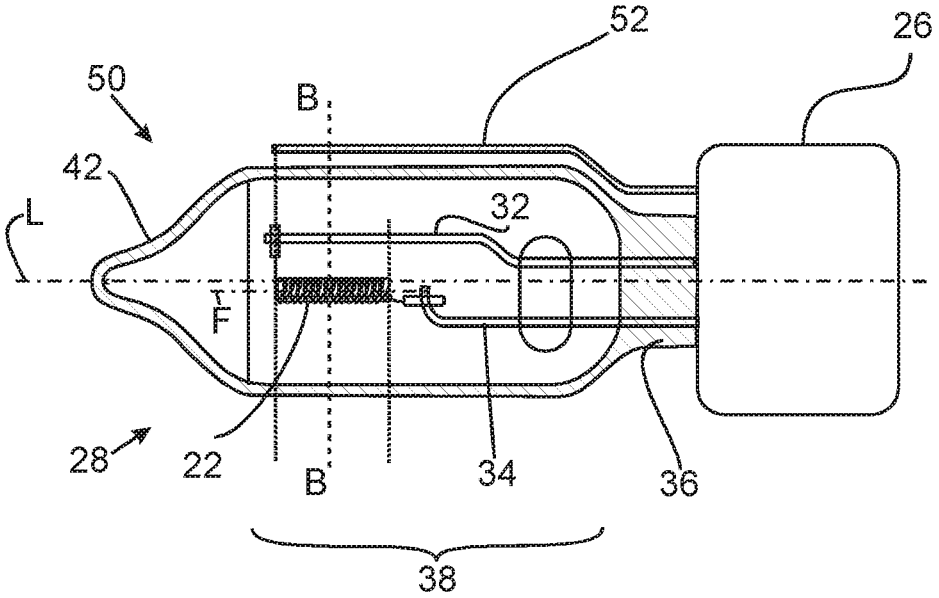
FIG. 4 shows a longitudinal sectional view of a second embodiment of a lamp.

FIG. 4 shows a second embodiment of a lamp 50. The lamp 50 according to the second embodiment corresponds to the lamp 20 according to the first embodiment in many parts. Like parts will be designated by like reference numerals. In the following, only differences between the embodiments will be further explained.

In the lamp 50 according to the second embodiment, a metal shield 52 is provided as heat shielding element. The metal shield 52 is provided as a thin sheet metal strip which, as visible from FIG. 4, FIG. 5, is fixed to the lamp cap 26 and extends in longitudinal direction of the lamp 50. The metal shield 52 is arranged in parallel to the cylindrical portion 38 of the burner 28.

The metal shield 52 is bent around the central longitudinal axis L of the lamp 50, as shown in FIG. 5. The shield 52 is arranged at a small distance of e.g. 1-2 mm to the bulb 24.

As the infrared filter coating 40 in the lamp according to the first embodiment, the shield 52 is arranged above the filament 52 to shield the top portion 18 of the reflector 12. The surface of the metal sheet 52 is reflecting, such that both light in the visible range and in the infrared range is reflected. The top portion 18 of the reflector 12 is therefore shielded from infrared radiation. Further, the shield 52, which is arranged at a certain distance from the bulb 24, also partially blocks convection of heated air directly upward from the bulb 24.

In circumferential direction, the metal shield 52, as shown in FIG. 5, extends over an angular range of $\alpha 1$, $\alpha 2$ in the same way as in the first embodiment, i.e. preferably symmetrically over a total angular range of 90°.

In axial direction, the shield 52 extends from the lamp cap 26 up to a position adjacent to the far end of the filament 22 as shown in FIG. 4, thus covering the entire axial length of the filament 22.

Since the shield 52 is of partly cylindrical shape, concavely bent around the central longitudinal axis L of the lamp 50, the mirror image of the filament 22 is formed above the central longitudinal axis L, shown in FIG. 5 in dashed lines. Thus, glare is avoided.

FIG. 6, FIG. 7 show a third embodiment of a lamp 60, corresponding to the above described second embodiment. In the following, only differences will be further explained.

In the lamp 60, a metal shield 62 is provided which extends in axial direction beyond the filament 22, and even beyond the far end of the lamp vessel 36. As shown in FIG. 6, FIG. 7, the shield 62 comprises a front portion 64 bent around the tip of the lamp vessel 36. A front portion of the shield 62 thus acts also as a glare shield, shielding light emitted from the filament 22 into directions which would not strike the reflector 12 of a vehicle headlight.

The extended, larger shield 62 according to this embodiment is even more effective to distribute heat, in particular in axial direction.

In a side view, looking along the central longitudinal axis L, the front portion 64 of the shield 62 may e.g. be of circular, square or otherwise angular shape.

It should be noted that the above-mentioned embodiments illustrate rather than limit the invention, and that those skilled in the art will be able to design many alternative embodiments without departing from the scope of the appended claims. For example, instead of an interference filter coating as described, different types of infrared filter coatings could be used. As a further alternative, instead of an infrared filter coating, also a mirror coating could be used.

In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The mere fact that certain measures are recited in mutually different dependent claims does not indicate that a combination of these measures cannot be used to advantage.

The invention claimed is:

1. A lamp comprising:

a light emitting element arranged within a sealed transparent vessel, wherein:

the vessel comprises at least a cylindrical section with a longitudinal axis (L) arranged in parallel to a longitudinal axis (F) of the light emitting element; and the cylindrical section of the vessel encloses the light emitting element; and a heat shielding element arranged to shield at least infrared light emitted from the light emitting element, wherein:

the heat shielding element is arranged in parallel to the longitudinal axis (F) of the light emitting element and has an axial extension of at least 80% of an axial length of the light emitting element;

the heat shielding element is arranged to shield infrared light emitted from the light emitting element into directions perpendicular to the longitudinal axis (F) of the light emitting element covering a circumferential extension of at least 20° and at most 120° measured in cross-section from the longitudinal axis (F) of the light emitting element;

the heat shielding element, when the lamp is arranged horizontally within a reflector of a vehicle headlight, is arranged above the light emitting element;

the heat shielding element is at least partly reflective of visible light; and the heat shielding element is shaped to create a mirror image of the light emitting element and the mirror image is located between the light emitting element and the heat shielding element.

2. The lamp of claim 1, wherein the heat shielding element is provided as a coating arranged on the vessel.

3. The lamp of claim 2, wherein the coating is an infrared filter coating allowing transmission of visible light while reflecting infrared light.

4. The lamp of claim 2, wherein the coating is a mirror coating.

5. The lamp of claim 1, wherein the heat shielding element is arranged to cover at least the axial length of the light emitting element.

6. The lamp of claim 1, wherein the axial extension of the heat shielding element is in a range of about 80% to about 125% of the axial length of the light emitting element.

7. The lamp of claim 1, wherein the light emitting element is a filament wound around a longitudinal filament axis, and wherein at least a first holding wire and a second holding wire extend from a lamp cap to hold the filament, at least a part of the first holding wire extending in parallel to the filament at a distance thereto, and wherein the heat shielding element is arranged symmetrically to an axial symmetry plane defined through the longitudinal filament axis and the first holding wire.

8. The lamp of claim 1, wherein the light emitting element is a filament, chosen such that the lamp has a nominal power of at least 60 W at a voltage of 13.2 V.

9. The lamp of claim 1, wherein the heat shielding element is comprised of a plurality of coatings applied on top of each other forming an interference filter.

10. The lamp of claim 1, wherein the heat shielding element is a metal shield arranged at a distance from the cylindrical section, the metal shield being fixed to the lamp.

11. The lamp of claim 10, wherein the metal shield is fixed to a cap of the lamp.

12. The lamp of claim 10, further comprising a bulb that is positioned in proximity to the metal shield such that the metal shield at least partially blocks convection of heated air from the bulb.

13. The lamp of claim 10, wherein at least a front portion of the metal shield is at least one of, a circular shape, or a square shape or an angular shape.

14. The lamp of claim 1, wherein the lamp is arranged within the reflector of the vehicle headlight, and wherein the reflector is made of a plastic material with a reflective coating.

15. The lamp of claim 14, wherein within a cross sectional plane arranged within a center of the light emitting element, a distance (d) between the light emitting element and a top portion of the reflector is 30 mm or less.

16. The lamp of claim 14, wherein the plastic material is a thermoplastic material.

17. The lamp of claim 16, wherein the thermoplastic material comprises at least one of, PC-HT, or PEI, or PSU, or PES.

18. The lamp of claim 1, wherein when the lamp is arranged horizontally within the reflector of the vehicle headlight, the longitudinal axis (F) of the light emitting element is located below the longitudinal axis (L) of the cylindrical section of the vessel; and the heat shielding element has a partial cylindrical shape with a cylinder axis that is arranged closer to the heat shielding element than the light emitting element.

19. The lamp of claim 18, wherein the cylindrical shape is bordered by straight edges.

* * * * *